US005274955A

United States Patent [19]

Dallaire et al.

[11] Patent Number: 5,274,955

[45] Date of Patent: Jan. 4, 1994

[54] CONSTRUCTION KIT FOR HORIZONTALLY AND VERTICALLY SLIDING WINDOW ASSEMBLIES

[75] Inventors: Raymond Dallaire; Dominique Dallaire, both of St. David, Canada

[73] Assignee: Dallaire Industries Ltd., Lauzon, Canada

[21] Appl. No.: 662,262

[22] Filed: Feb. 28, 1991

[30] Foreign Application Priority Data

Mar. 1, 1990 [CA] Canada ..... 2011239

[51] Int. Cl.[5] ..... B65B 31/00

[52] U.S. Cl. ..... 49/406; 49/458; 49/501; 49/504

[58] Field of Search ..... 49/161, 458, 406, 460, 49/380, 501, 504, 404, 475.1, 428, 489.1

[56] References Cited

U.S. PATENT DOCUMENTS

| | | | |
|---|---|---|---|
| 3,225,393 | 12/1965 | Collar | 49/458 X |
| 3,859,754 | 1/1975 | Budich et al. . | |
| 4,087,941 | 5/1978 | Wolfe . | |
| 4,227,346 | 10/1980 | Kubik | 49/501 X |
| 4,265,052 | 5/1981 | Johnson et al. | 49/501 X |
| 4,351,131 | 9/1982 | Kubik . | |
| 4,428,156 | 1/1984 | Malm et al. | 49/501 |
| 4,482,099 | 11/1984 | Schmidt | 49/504 X |
| 4,555,868 | 12/1985 | Mancuto | 49/501 X |
| 4,580,366 | 4/1986 | Hardy | 49/458 X |
| 4,742,664 | 5/1988 | Johnson | 49/501 X |
| 4,799,332 | 1/1989 | Haas | 49/406 X |
| 4,944,118 | 7/1990 | Bird | 52/207 X |
| 4,949,506 | 8/1990 | Durha | 49/501 X |
| 5,014,466 | 5/1991 | Winner | 49/504 |
| 5,042,199 | 8/1991 | Schneider et al. | 49/501 |

FOREIGN PATENT DOCUMENTS 1138716 1/1983 Canada .

*Primary Examiner*—Peter M. Cuomo
*Assistant Examiner*—Jerry Redman
*Attorney, Agent, or Firm*—James D. Hall

[57] ABSTRACT

A construction kit for horizontally and vertically sliding window assemblies in which each window includes a sash. A meeting rail is connected to each sash and includes a slot at each of the inner and outer surfaces of the meeting rail. Weather stripping is fitted into the slot at outer surface of the meeting rail and is wrapped around the end of the meeting rail and secured within the slot at the inner surface of the meeting rail.

4 Claims, 10 Drawing Sheets

CONSTRUCTION KIT FOR HORIZONTALLY AND VERTICALLY SLIDING WINDOW ASSEMBLIES

TECHNICAL FIELD

The present invention relates to window assemblies and more particularly to a construction kit for horizontally or vertically sliding windows wherein a single set of extruded profiles are used to construct either type of window.

BACKGROUND ART

There has been a long standing interest in providing a simplified construction kit for interchangeably building either horizontally or vertically sliding windows. Various constructions have been proposed. Examples of such window constructions are described in the following patents:

U.S. Pat. No. 3,859,754—Budich
U.S. Pat. No. 4,087,941—Wolf
U.S. Pat. No. 4,351,131—Kubik
Canadian Patent 1,138,716—Budich The various sliding closure constructions disclosed in these patents suffer from certain drawbacks which have largely prevented their commercial acceptance. One common disadvantage of the window constructions of the type disclosed in the patents listed above is that their profile design is not adequately rigid to support a heavy window. As a result, the profiles often require reinforcement in the form of metal box beams and the like. A further disadvantage is that the window assemblies described in the prior art require the addition of wheel assemblies to the sashes of the horizontally sliding window, necessitating extruded track profiles which must be added to the basic assembly. The addition of such track profiles requires machining and fitting of parts which is both time consuming and expensive. Furthermore, such track assemblies often protrude laterally over the edges of the main frame, which distracts from the aesthetic qualities of the window and contributes a structural weak point which may be damaged during handling and/or transport of the window assembly. An additional drawback of the window assemblies of the known prior art is that the sill structure is generally flat and thereby fails to provide adequate surface for efficient weather stripping. This makes those window assemblies vulnerable to the intrusion of air and water and thereby detracts from their desirability.

DISCLOSURE OF THE INVENTION

Accordingly, it is an object of the present invention to provide a new and improved construction kit for horizontally and vertically sliding window assemblies which overcomes the disadvantages set forth above.

It is a further object of the invention to provide a sliding window assembly which provides improved weather sealing characteristics.

It is yet a further object of the invention to provide a construction kit for horizontally and vertically sliding window assemblies which uses a minimal number of extruded profiles for constructing either type of window.

In a preferred embodiment of the invention a window is constructed having a main frame including a sill, opposing jambs and a header, each of which is made using a single multi-chambered extruded plastic profile. The extruded plastic profile for the main frame includes an inner and an outer sash support surface. The outer sash support surface is upwardly offset relative to the inner sash support surface so that the outer pane of the closure is somewhat smaller than the inner pane. This arrangement provides for improved weather stripping of the window as an additional vertical surface is provided between the inner and outer sash support surfaces to accommodate the abutment of an additional weather strip between the panes.

The glazing of the window construction is likewise supported by a single multi-chambered extruded plastic profile from which the fours sides of each sash are assembled. The profile includes a box shaped main member, an upstanding side section integral with the main member which includes two horizontally spaced-apart flexible co-extruded pliable glazing strips, and an inwardly angled socket on its opposite edge for receiving a snap-in glazing member to complete the sash. A special snap-in glazing member is also provided which includes an integral laterally projecting handle to obviate the need of installing any auxiliary hardware for opening the window.

Another feature of the invention is a snap on meeting rail which may be attached to any side of a sash frame by a simple yet effective mechanical engagement that requires neither glue nor fasteners. The meeting rail is further provided with a novel feature wherein a weather strip retainer groove is provided on both the front and rear surfaces of the meeting rail. Weatherstrip is affixed to the meeting rail by cutting the weather strip extra long and bending each of its ends around the meeting rail and inserting them into the grooves provided on the back surface of the meeting rail. When the meeting rail is snapped into place on a sash frame, the free ends of the weather strip on the rear surface of the meeting rail are securely fastened between the meeting rail and the window sash. This obviates any requirement for glue or other fasteners to attach the weather strip to the meeting rail and further provides a superior seal between the ends of the meeting rail and the opposing jambs of the window sill.

Yet a further feature of the invention are snap-in guide rails which are likewise provided with grooves for suppoorting a weather strip. These guide rails may be snapped into any one of two slots provided on the main frame profile. This contributes significantly to the versatility of the window construction kit and improves the weather seal of the windows by providing auxiliary weather stripping where needed.

An additional feature of the invention is the fact that the horizontally sliding sashes of windows constructed in accordance with the invention slide on very high density polyethylene shoes rather than on wheels in the traditional fashion. This provides a much more economical window which is more dependable in use and yet operates with surprising ease.

Still a further feature of the invention is that a construction kit for horizontally and vertically sliding window assemblies is provided which includes only seven extruded plastic profiles that are nearly exclusively snap locked or heat welded together, very few fasteners being required. Thus an extremely economical, quickly and efficiently assembled, and rugged window system is provided by the present invention.

Thus, there is provided in accordance with the invention a construction kit for horizontally or vertically sliding window assemblies characterized in that either of a vertically displacable and a horizontally displacable window maybe assembled from a set of six extruded profiles, comprising:

an extruded hollow frame profile of constant cross-section for assembling a window frame that includes a sill, a header and opposed vertical jambs, said frame profile including an inner and an outer flat sash support surface, which surfaces are adjacent and parallel, each said surface including an open guide track that communicates with a hollow chamber beneath the respective surface and a slot adjacent to and parallel with an inner edge of each said surface;

an extruded hollow sash profile of constant cross-section for assembling window sashes to fit within the window frame, said sash profile including a box-shaped main member having an upstanding side section integral with one top edge of the main member and including integral glazing means for sealing contact with one side of a window pane, and an inwardly angled socket which extends along the top edge of an opposite side of the box-shaped main member for receiving a snap-in glazing member;

a snap-in glazing member profile for completing the sash profile, said glazing member including a main body portion having a cross-section similar to the upstanding side section of the sash profile and including integral glazing means on its one side for sealing contact with an other side of the window pane and a leg portion which depends from a bottom edge of the main body portion, the leg portion being shaped to mechanically and frictionally engage the inwardly angled socket in the sash profile;

an L-shaped meeting rail profile which includes integral fastener means for attaching the meeting rail to a side of the window sash for inhibiting the flow of air between two adjacent sashes in a closed condition;

a snap-in guide rail for guiding a sash on a sash support surface of the frame profile, the guide rail including a linear body having a depending leg for frictional engagement in the slot adjacent the inner edge of the sash support surface to retain the guide rail in a fixed position above the slot; and a guide track cap profile for selectively concealing the guide track in the frame profile to provide a flat smooth surface for slidably supporting a horizontally displacable window sash, and for providing an aesthetic finish for the sash support surfaces of the frame profile in areas of a window where the guide track does not contribute to the function of the window assembly.

BRIEF DESCRIPTION OF THE DRAWINGS

A preferred embodiment of the invention will now be described by way of example only and with reference to the following drawings, wherein.

MODES FOR CARRYING OUT THE INVENTION

Figure 1:
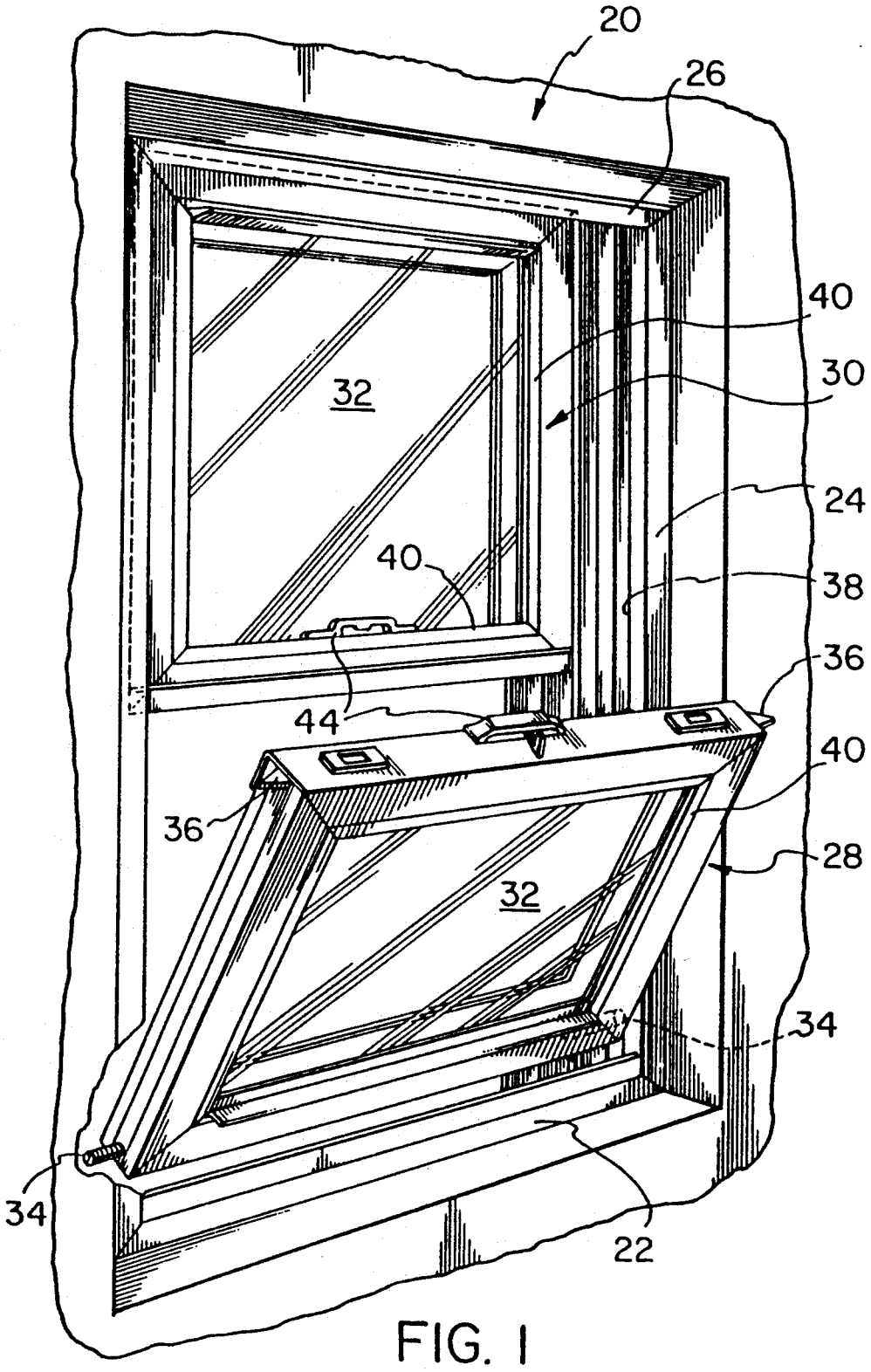
FIG. 1 is a perspective view of a vertically sliding window in accordance with the invention, including areas which are partially cut away to show certain details of the construction.

FIG. 1 illustrates a vertically sliding double-hung window constructed from a kit in accordance with the invention. The vertically sliding double-hung window, generally indicated by the reference 20, has a main frame which includes a sill 22, opposed vertical jambs 24 and a horizontal header 26. The four parts of the main frame are made using a single multi-chambered extruded plastic profile as will be explained in detail hereinafter. The main frame slidably supports a bottom sash, generally indicated by reference 28, and a top sash, generally indicated by reference 30. The four sides of each sash frame are likewise made from a single extruded plastic profile which will also be explained in detail hereinafter. The sashes are each pivotally supported by pivot pins 34 which are attached to sash balance mechanisms (not illustrated) that are well known in the art and widely commercially available. The sashes are supported on their top corners by spring loaded sash latches 36 having angled ends which are biased toward their extended position to engage guide tracks 38 formed as an integral part of the main frame jambs 24. Each sash profile includes an upstanding glazing strip on its one side and a longitudinal socket formed along the top edge of its opposite side, which socket lockingly receives a snap-in glazing member 40, also explained in detail hereinafter. The snap-in glazing members 40 support glass panes 32, which are generally hermetically sealed thermopanes that include at least two parallel spaced-apart panes of glass. The top edge of the bottom sash 28 and the bottom edge of the top sash 30 include meeting rails which are equipped with weather stripping to provide a weather-tight seal between the junction of the top and bottom sashes. Windows of this type also generally include a window lock mechanism 44 having complementary components oppositely affixed to each of the two sashes.

Figures 2, 2A:
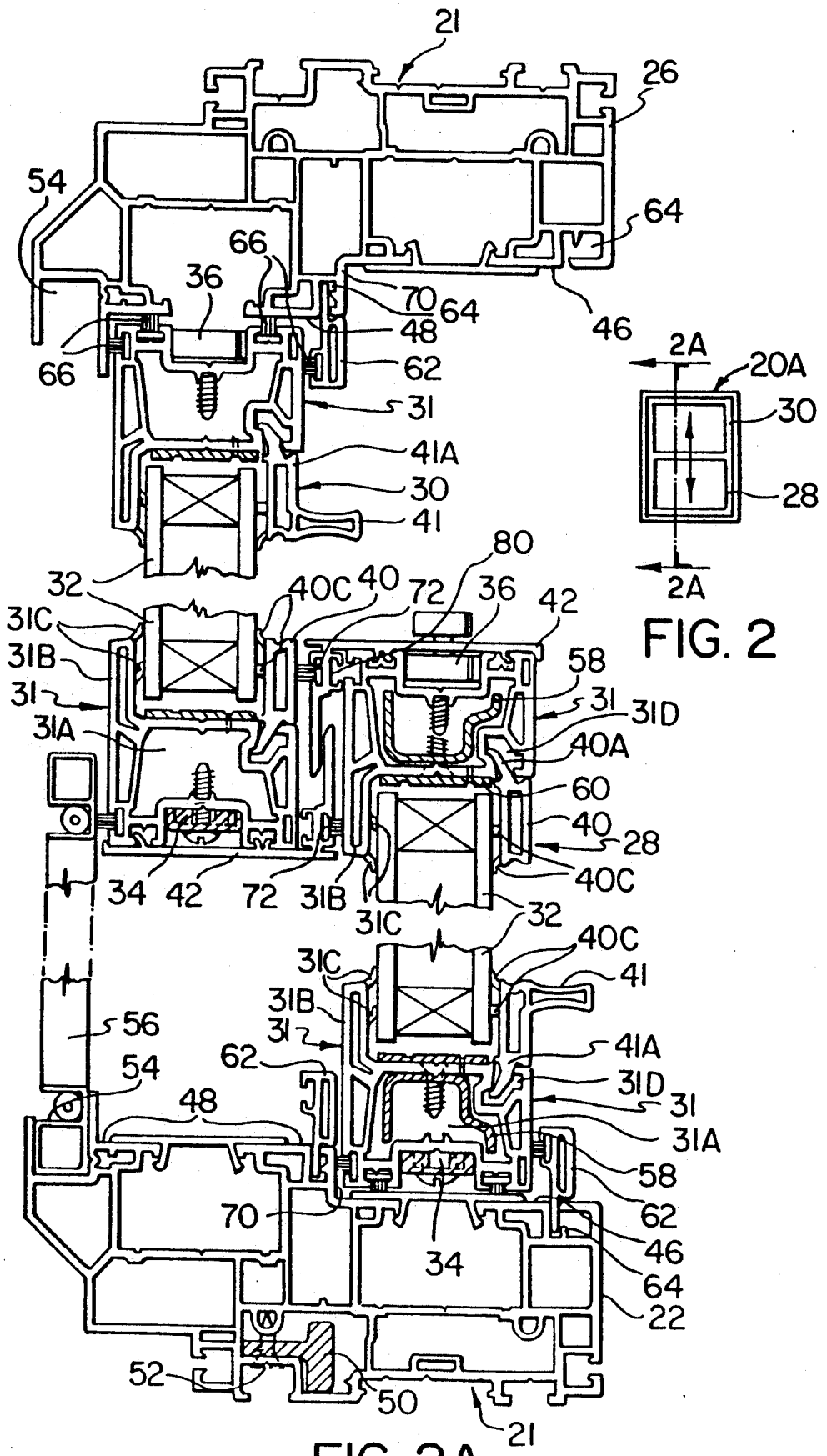
FIG. 2 is a front elevational view of the vertically sliding window shown in FIG. 1.
FIG. 2A is a vertical cross-section taken along line 2A—2A of FIG. 2.

FIG. 2 shows a front elevational view of the vertically sliding window illustrated in FIG. 1. FIG. 2A is a vertical cross section taken along line 2A—2A of FIG.

2. As is apparent, the bottom sill 22 and the header 26 are each made from the same multi-chambered extruded plastic main frame profile, generally indicated by the reference 21. The main frame profile 21 includes an inner sash support surface 46 and an outer sash support surface 48. As is apparent, the outer sash support surface 48 is upwardly offset relative to the inner sash support surface 46. The significance of this feature will be discussed hereinafter with reference to weather stripping. As is further apparent, the only difference between the main frame header 26 is a light metal reinforcement member 50 which runs the length of the sill 22 and is attached thereto by screw fasteners 52, spaced apart at intervals. The main frame extrusion 21 further includes a window screen support track 54 formed along its outer edge. The window screen support track provides a positive support against both the inner and outer perimeter of window screen 56 which minimizes the intrusion of insects by compensating for any warping or manufacturing tolerance in the window screen frames.

Each window sash, 28 and 30 respectively, is likewise constructed from a single mult-chambered extruded plastic profile, generally indicated by reference 31. The sash profile 31 comprises a substantially L-shaped extrusion which includes a hollow box-shaped main member 31A and an integral upstanding side section 31B that supports two vertically space-apart integral co-extruded pliable glazing strips 31C. Thus, sashes are quickly and efficiently constructed using the sash profile 31 by mitering four profiles to the proper length and heat welding the mitered profiles together on each of the four corners of the sash. A thermopane 32 is then laid into the thus constructed frame and snap-in glazing members 40, which include two vertically spaced-apart integral co-extruded pliable plastic glazing strips 40C rapidly complete the construction without any requirement for additional caulking on glazing. Using these techniques a window is glazed in a small fraction of the time required by more traditional glazing methods. It should be noted that the snap-in glazing member 40 is seated in a specially designed socket 31D which frictionally and mechanically retains the snap-in leg portion 40A of glazing member 40. The cooperating angles of the snap-in leg 40A and the socket 31D have been carefully calculated to provide a snap-together joint which offers a maximum of separation resistance while providing the maximum ease of assembly.

Another feature of the invention is the snap-in glazing member 41 which includes an integral handle for raising and lowering sashes 28 and 30 respectively. Traditional window sashes of the vertically sliding type are commonly equipped with a pair of spaced apart handles which are screwed to the movable sash. This, of course, requires additional hardware and fasteners and the additional labour to install them. Thus, the snap-in glazing member 41 with an integral handle is a labour-saving device which also contributes to the aesthetics of the window construction.

The sash frame members 31 of the vertically slidable inner pane 28 are preferably reinforced by a light weight metallic reinforcement member 58 which is contoured as illustrated. The glass thermopane 32 preferably rests on pliable plastic strips 60 which have a hardness of approximately 85 durometer.

A further feature of the invention are the snap-in guide rails 62 which lend additional flexibility to the window construction kit. It will be appreciated by those skilled in the art that the snap-in guide rails 62 may be placed in either of two slots formed internally in the main frame extrusion 21. The guide rail slots 64 are respectively preformed in the inner edges of sash support surfaces 46 and 48. It will be further appreciated by those skilled in the art that guide rails 62 serve as a weatherstrip support member as well as a guiding rail for the sashes of the window frame. In addition, a guide rail 64 may be placed along the inner edge of sash support surface 48 or the sill 22 to act as a water barrier to prevent the migration of water across the outer sill. This placement is optional and does not contribute to the weather stripping of the window construction. As may be seen at the bottom of the inner sash 28 and the top of the outer sash 30, each sash is provided with four longitudinally oriented weatherstrips to provide a seal between the outside atmosphere and the interior of the window. The upwardly offset step from the inner sill support surface 46 to the outer sill support surface 48 provides an additional vertical surface 70 which is preferably contacted by a weatherstrip. Thus, the snap-in guide rails 62 and the vertical wall 70 double the weatherstrip capacity of the window, providing a sliding window system with at least double the weatherstrip capacity of the average system of similar construction disclosed in the prior art.

Figures 10, 10A:
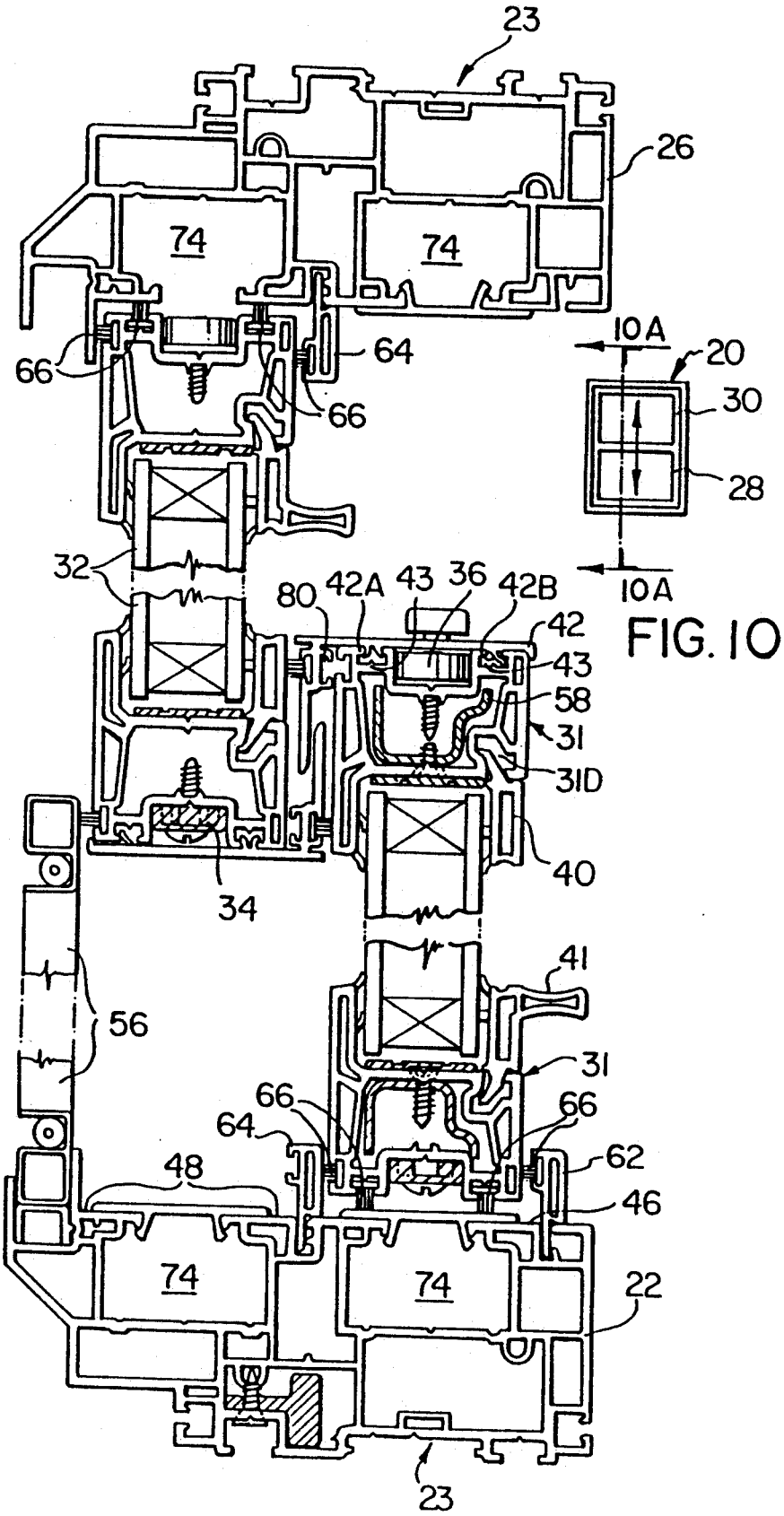
FIG. 10 is a front elevational view of an alternate embodiment of the vertically sliding window shown in FIG. 1.
FIG. 10A is a vertical cross-section taken along line 10A—10A of FIG. 10.

FIGS. 10 and 10A show an alternate vertically sliding window construction in accordance with the invention, wherein the window frame extrusion provides a flat sill surface.

The same weatherstripping capacity may also be achieved in this alternate, flat sill support surfaced main frame profile 23, shown in FIG. 10. In this alternate embodiment of the main frame, the respective sashes 28 and 30 are identical in size. The fourth weather strip abutting surface at the bottom of the inner sash 28 is provided by a snap-in guide rail 62 which is installed on the outer side of the bottom sash. The main frame profile 23 is equally adapted to the construction of horizontally sliding windows (not illustrated). All other components of the construction kit for horizontally and vertically sliding windows hereinbefore and hereinafter described are equally adapted for use with either of main frame profile constructions 21 or 23. Whenever reference is made to main frame profile 21 hereinbefore or hereinafter, the same reference may be equally applied to main frame 23, unless the shape or the relative positions of the sash supporting surfaces of the main frame profile is being described.

Sashes 28 and 30 are also respectively provided with meeting rails 42 which clip onto the outer surface of the sash extrusions 31 without any requirement for glue or mechanical fasteners. Each meeting rail is provided with a longitudinally extending weather strip 72, which shall be described in more detail in reference FIG. 4A.

As is readily apparent from an inspection of FIG. 10A, the meeting rails 42 include integral locking tabs 42A and 42B which extend the full length of each rail. The locking tabs engage longitudinal slots 43 in the backs of each window sash profile 31. The longitudinal slots 43 also serve as weatherstrip retainer slots on the opposite side of the sash, as will be explained in more detail below.

Figure 3A:
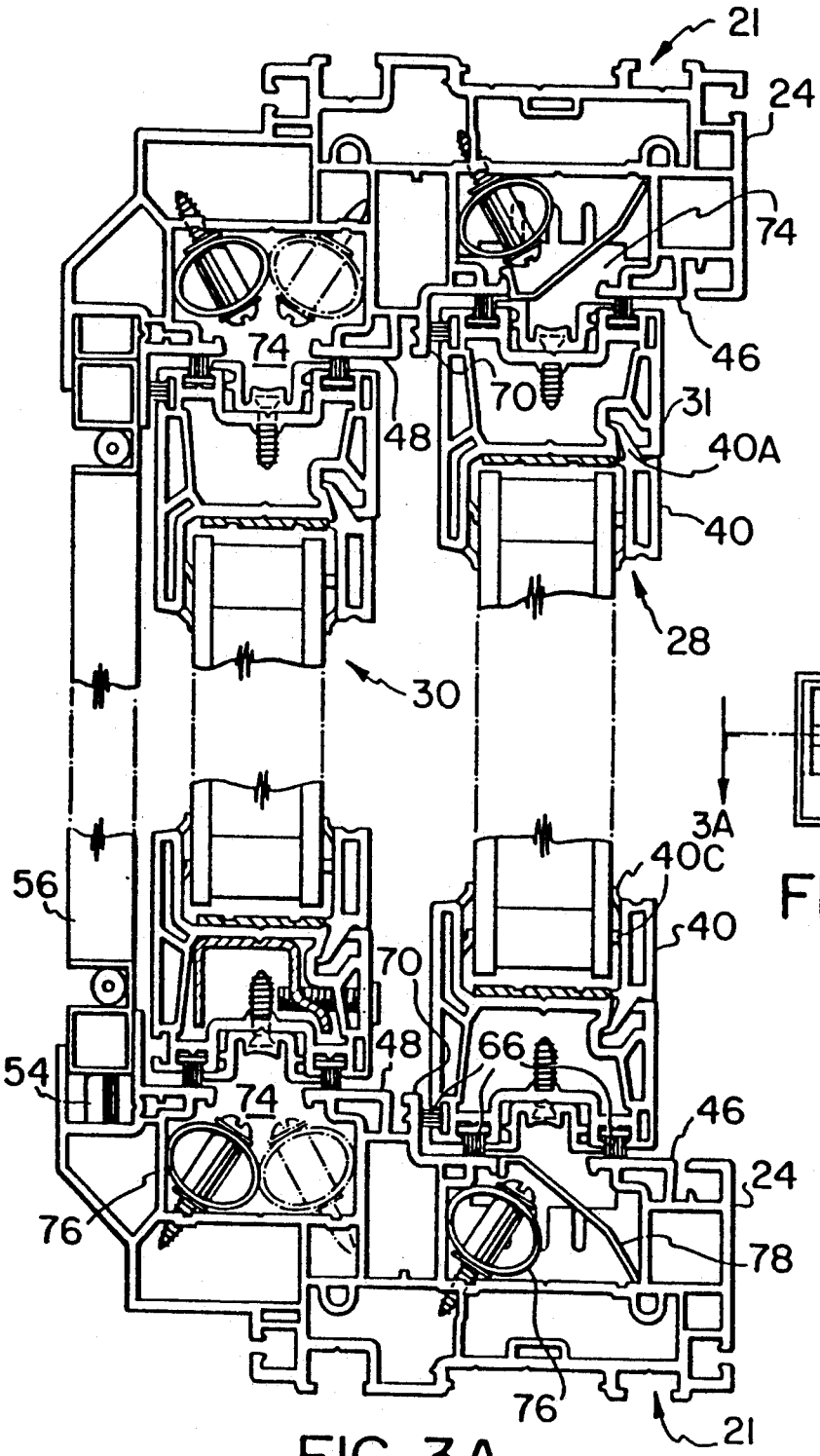
FIG. 3A is a horizontal cross-section taken along line 3A—3A of FIG. 3.
Figure 3:
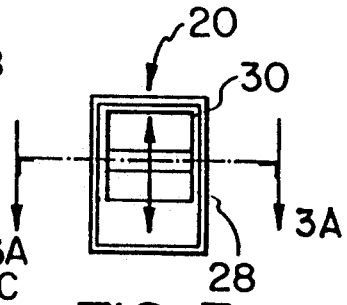
FIG. 3 is a front elevational view of the vertically sliding window shown in FIG. 1 in a partially opened condition.

FIG. 3 shows the vertically sliding window of FIG. 1 in a partially opened condition. FIG. 3A is a horizontal cross-section taken along line 3A—3A of FIG. 3. The cross-section of the vertical jambs 24 show that the jambs are constructed from the same extruded plastic main frame profile 21 as are the sill 22 and header 26 (see FIG. 2A). It should be noted that inner sash support surface 46 and outer sash support surface 48 have their guide tracks 74 open to accommodate pivot pins 34 and spring loaded sash latches 36 (See FIG. 1) as will be explained hereinafter in relation to FIG. 4A. An inspection of the profiles of each of the sashes shows that the same extruded profiles is used for the style of each sash frame. Each sash, 28 and 30 respectively, is provided with three weatherstrips 66 which provide a barrier to the intrusion of outside air. It should be noted that the vertical wall formed by the upwardly offset outer sash support surface 48 provides an additional surface for the application of weatherstriping as does the inner wall of the window screen support track 54. Each pane is supported in its track by a window sash balancing mechanism 76. Window sash balancing mechanisms are well known in the art and readily commercially available. As is apparent, the window sash balancing mechanism for the fixed pane may be mounted in either corner of the guide track cavity 74 whereas the sash balancing mechanism for the movable pane can only be mounted in the outer corner because the spring loaded sash latch 36 (not illustrated in the FIG.) must run in the inner guide track 74. For aesthetic reasons, the sash balancing mechanism for the inner sash 28 is covered by a snap-in profile 78 which is contoured to avoid interference with the spring loaded sash latches 36.

Figure 4A:
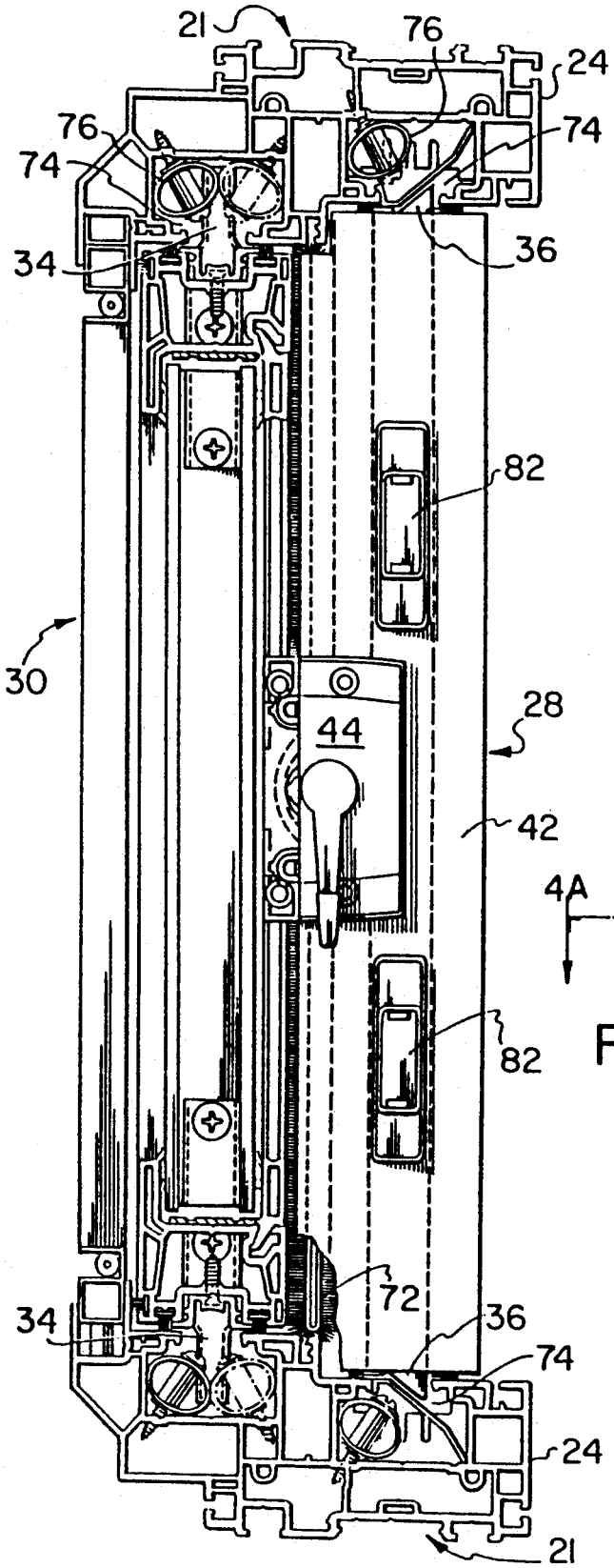
FIG. 4A is a horizontal cross-section taken along line 4A—4A of FIG. 4.
Figure 4:
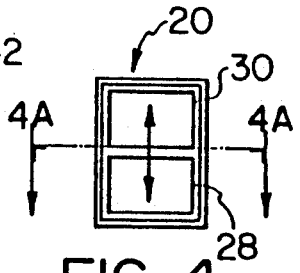
FIG. 4 is a front elevational view of the vertically sliding window shown in FIG. 1.

FIG. 4 is a front elevational view of the vertical sliding closure shown in FIG. 1, in a closed condition. FIG. 4A is a horizontal cross-section taken along line 4A—4A of FIG. 4. The meeting rail 42 of the inner sash 28 is partially cut away on one corner to illustrate a further important aspect of the invention, the meeting rail is provided with a slot 80 for retaining a weather strip on both its inner and outer edges (see FIG. 2A). Traditionally meeting rails have a slot for accommodating weather strip on their outer surface only. The weather strip was therefore cut to a precise length and glued or otherwise fastened in its slot to prevent it from working to one side of the meeting rail and being torn out from its slot. By providing a weather strip slot in both the front and back surfaces of the meeting rail, the weather strip may be cut longer than the meeting rail and each end may be bent rearwards around the ends of the meeting rail and inserted into the corresponding slot 80 (See FIG. 10A) in the back of the meeting rail 42. When the meeting rail 42 is clipped onto the top of the sill, that portion of the weather stripping in the slot 80 on the back of each end of the meeting rail 42 is compressed between the sash and the back side of the meeting rail. This effectively secures the weather strip 66 in the meeting rail slots 80 and obviates any requirement for glue or other fasteners. It also provides a much improved seal between the ends of the meeting rails 42 and the adjacent jambs 24.

The path of travel of pivot pins 34 and spring loaded sash latches 36 may also be appreciated by an inspection of FIG. 4A. Sash latches 36 slide in guide tracks 74, as do pivot pins. 34. In order to release the top edge of inner sash 28 from its vertical position and pivot it downwards for cleaning or maintenance, finger pulls 82 are simultaneously pulled toward each other to retract the outer ends of the sash latches 36 and release the top of the inner sash 28 from its guide track 74. Once the sash latches 36 are retracted from guide tracks 74, the sash may be freely pivoted downwards. The sash latches 36 automatically re-engage guide tracks 74 when the window is returned to its upright position.

Figure 5:
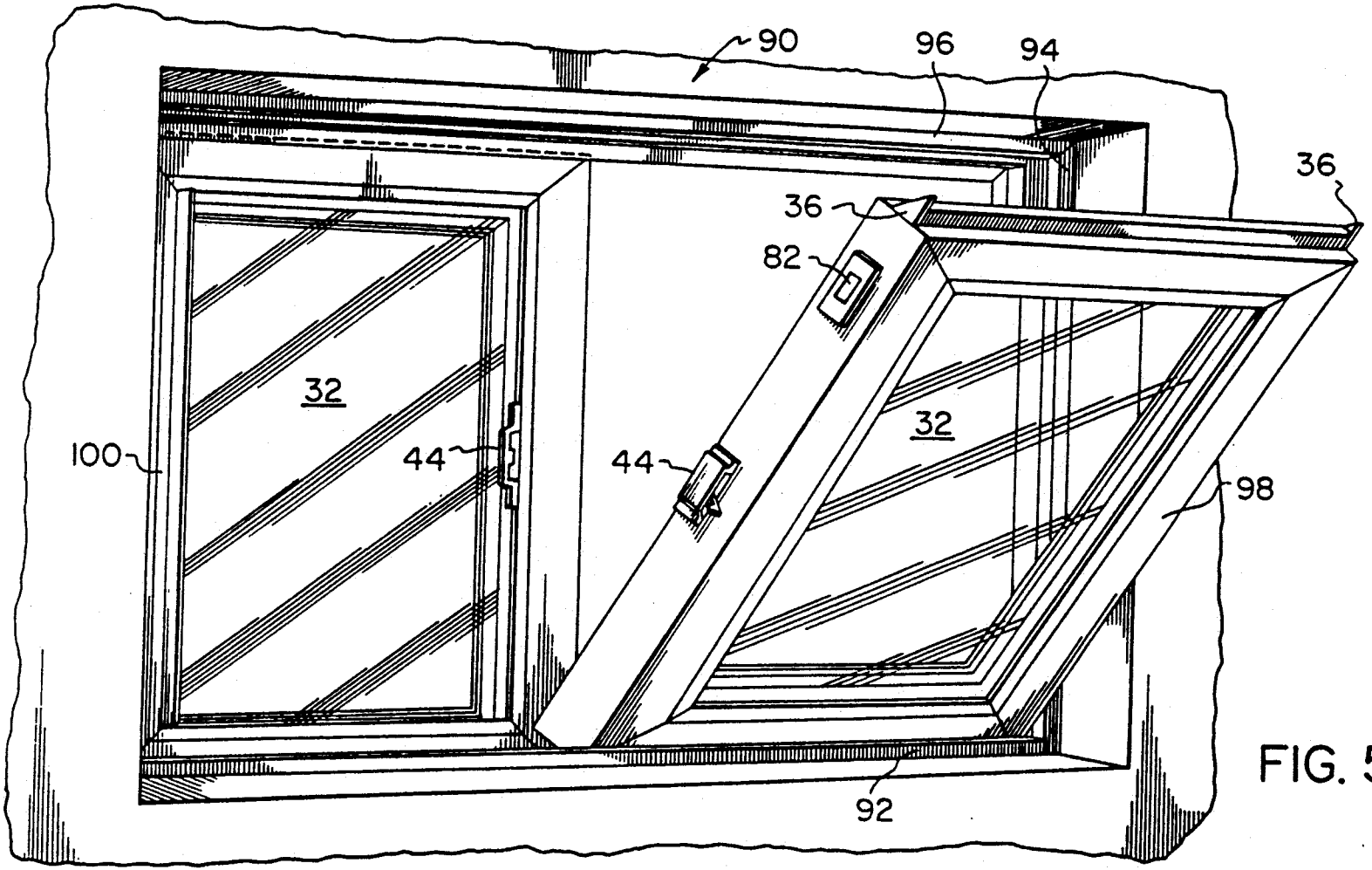
FIG. 5 is a perspective view of a horizontally sliding window assembly in accordance with the invention.

FIG. 5 illustrates a horizontal sliding window in accordance with the invention, generally indicated by the reference 90. The horizontal sliding window 90 includes a sill 92, opposed vertical jambs 94 and a header 96 which surround and support an inner sash 98 and an outer sash 100. The horizontal sliding window 90 is constructed using the same main frame profile 21 and sash profile 31 as will become apparent when reference is made to FIGS. 6A through 9A. Each sash supports panes of glass, generally hermetically sealed thermopanes 32. Each sash is retained in a vertical position by a pair of spring loaded sash latches 36 which slide in guide tracks 74 (See FIG. 8A). Normally the sashes are also provided with the complementary components of a window lock mechanism 44.

Figure 6A:
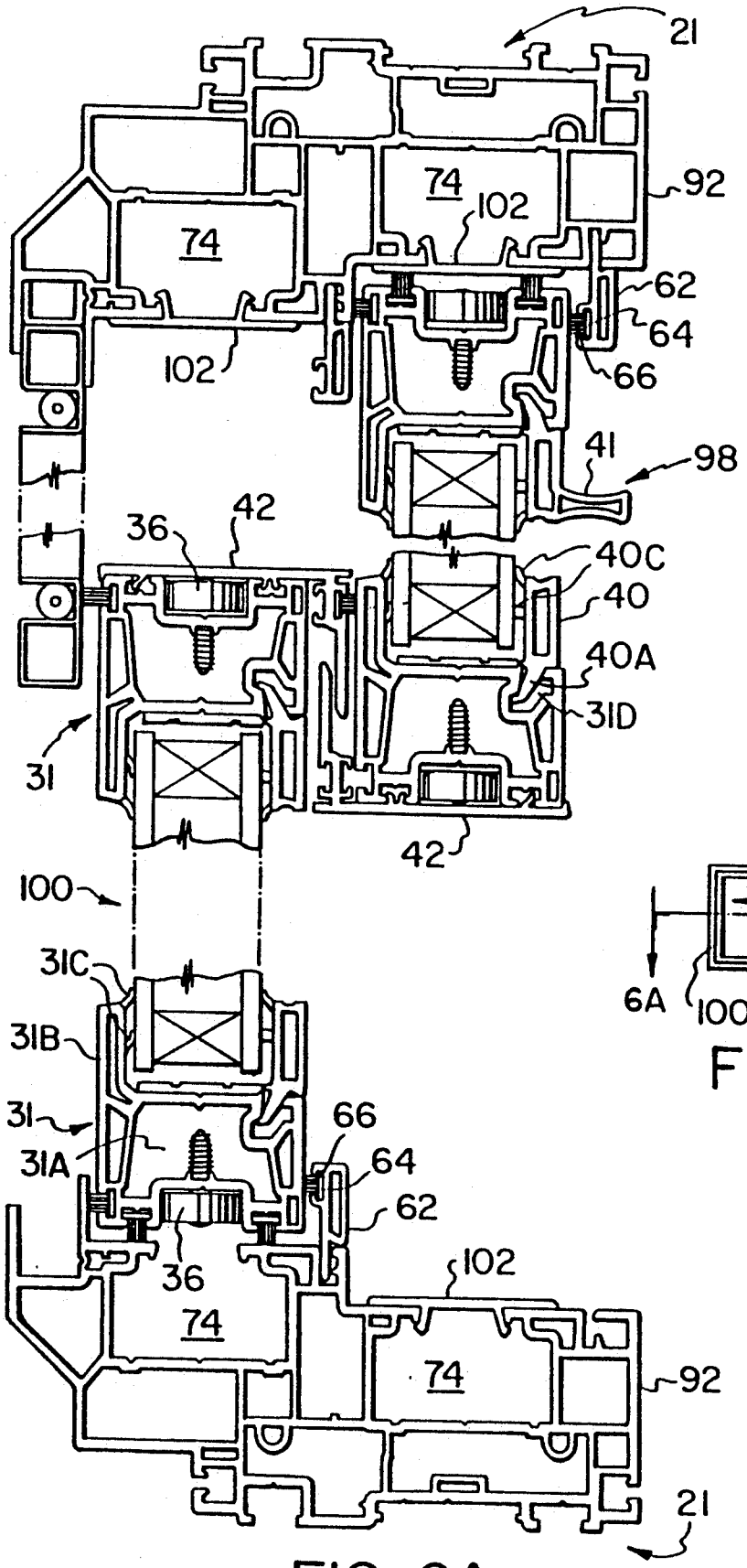
FIG. 6A is the horizontal cross-section taken along line 6A—6A of FIG. 6.
Figure 6:
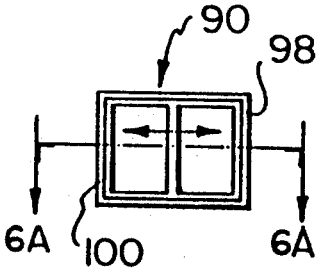
FIG. 6 is a front elevational view of the horizontally sliding window shown in FIG. 5.

FIG. 6 is a front elevational view of the horizontally sliding window shown in FIG. 5.

FIG. 6A is a horizontal cross-section taken along the lines 6A—6A of FIG. 6. The jambs 94 of the horizontal sliding window 90 are made from the same main frame profile 21 as was used in the construction of the vertical sliding window. Since the vertical guide tracks 74 in jambs 94 are not used for horizontal sliding window 90, they are covered with clip in guide track caps 102 which are extruded plastic profiles that include opposing legs that snap into guide tracks 74 and are securely held in place without a requirement for glue or other fasteners. It should be readily appreciated that the other extrusion profiles used in the horizontal sliding window 90 are exactly the same as previously described for the vertical sliding window 20. The weatherstripping, sash construction, glazing, and meeting rails are all identical to those used in the construction of the vertically sliding window 20.

Figures 7, 7A:
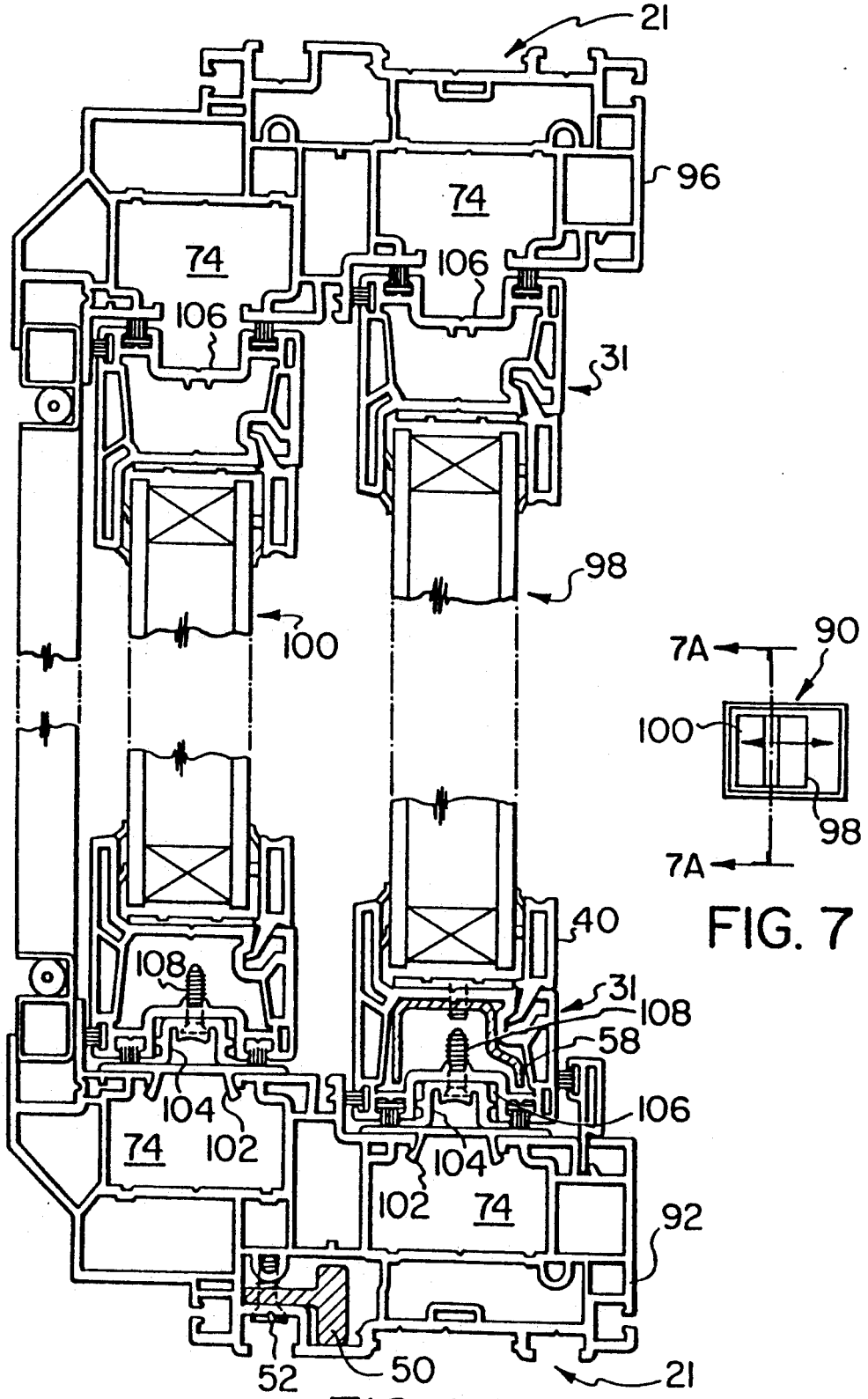
FIG. 7 is a front elevational view of the horizontally sliding window shown in FIG. 5, in a partially opened condition.
FIG. 7A is a vertical cross-section taken along line 7A—7A of FIG. 7.

FIG. 7 is a front elevational view of the horizontal sliding window 90 shown in FIG. 5, the window being in a partially opened condition.

FIG. 7A is a vertical cross-section taken along line 7A—7A of FIG. 7. The sill 92 and the header 96 of the horizontally sliding window are each made from the main frame profile 21 used in the vertical sliding window. The sill 92 is likewise reinforced with a small T-shaped metallic reinforcement member 50 affixed to the sill at intervals by screw fasteners 52. The sash profiles of the inner sash 98 and outer sash 100 are respectively made from the sash profile 31 used in the vertically sliding window 20. Because there is less mechanical stress on the horizontally sliding sash 98 than on the vertically sliding bottom sash 28, only one contoured metal reinforcement member 58 is required in the sash and it is located in the bottom sash profile. With that exception, the sashes are identical to those used in the vertical sliding window. Likewise, the glazing and the weather stripping of each sash are identical to those previously described. The vertical sliding panes 98 and 100 slide on very high density polyethylene shoes 104 which are attached to the opposite end regions of each sash. The very high density polyethylene shoes 104 are attached in the central groove 106 in the outer edge of the sash profile 31 by a screw fastener 108. The very high density polyethylene glides with very little friction over the guide track caps 102, providing a smoothly operating horizontal slider which obviates the requirement for the wheels and tracks traditionally used in horizontally sliding thermopane windows. It should be noted that the guide tracks 74 in the frame header 96 are not covered by guide tracks caps 102. This is due to the fact that the spring loaded sash latches (See FIG. 8A) must slide in those guide tracks 74.

Figures 8, 8A:
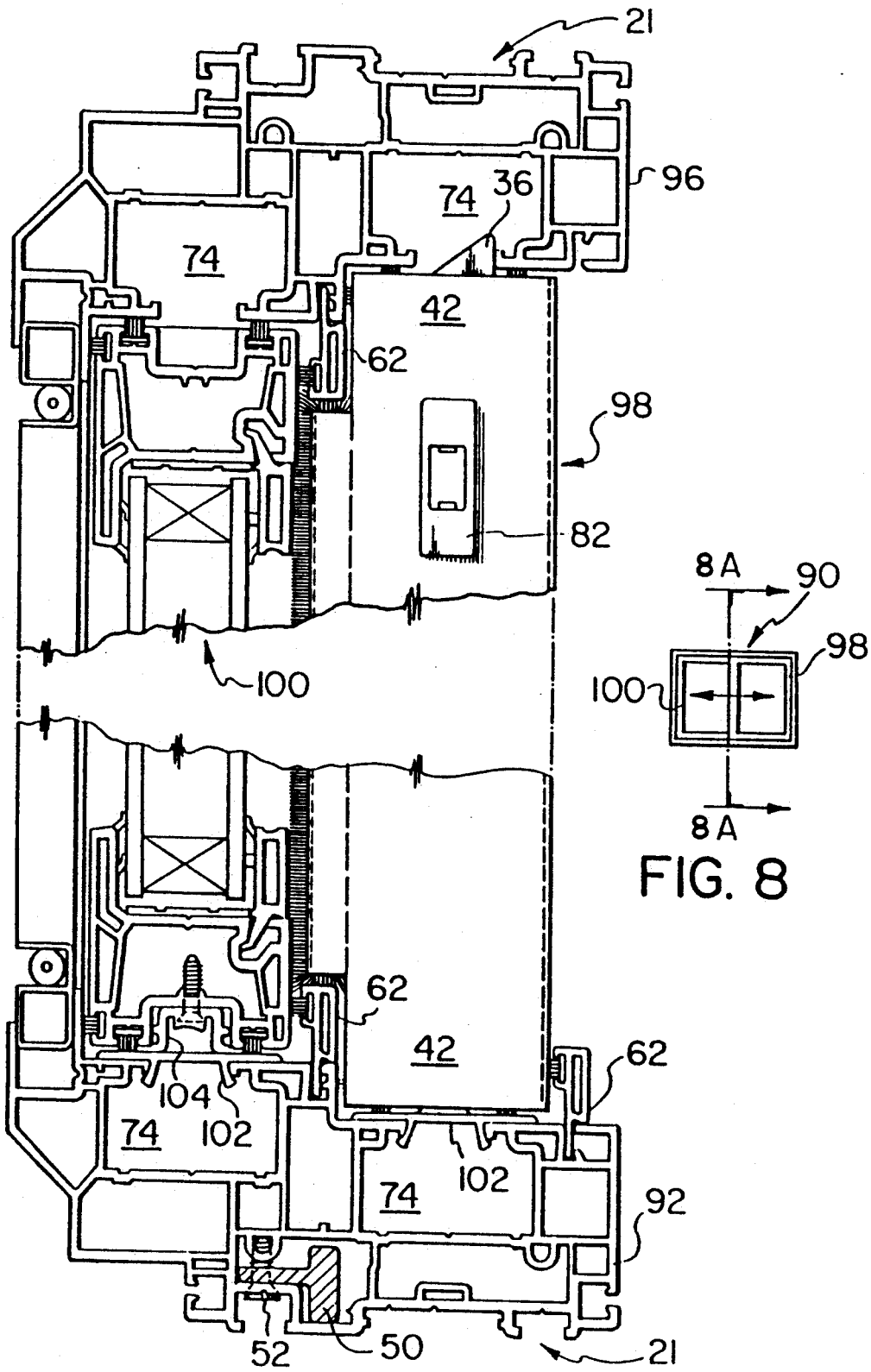
FIG. 8 is a front elevational view of the horizontally sliding window shown in FIG. 5.
FIG. 8A is a vertical cross-section taken along line 8A—8A of FIG. 8.

FIG. 8 is a front elevational view of the horizontally sliding window shown in FIG. 5, the window being in a closed condition.

FIG. 8A is a vertical cross-section taken along lines 8A—8A of FIG. 8. The spring loaded sash latch 36 on the top corner of inner sash 98 may be seen in the guide track groove 74. It should be noted that the sliding sash 98 is retained along its top edge by a spring loaded sash latch 36 and along its bottom edge by a snap-in guide rail 62. The fixed panel is likewise supported along its top edge by spring loaded sash latches 36 (See FIG. 8A) and along its bottom edge by a snap-in guide rail 62. It should be further noted that the meeting rails for this horizontally sliding window are, with the exception of some minimal machining at each end to accommodate the snap-in guide rails 62, identical to the meeting rails used for the vertically sliding window 20. It should also be noted that the same method of wrapping the meeting rail weatherstripping around each end of the meeting rail 42 and tucking it in the auxiliary slot 80 (See FIG. 2A) on the back surface of the meeting rail obviates the requirement of glue or other fasteners to retain the meeting rail weatherstrip in its operative position. It should be further noted that this method of attaching the meeting rail weatherstrip provides a more positive seal between the snap-in guide rails 62 at the top and bottom edges of the inner side of the fixed sash and the adjacent ends of the meeting rails. In addition, it should be understood that the snap-in guide rail 62 illustrated at the top inside horizontal edge of the fixed sash 100 is an optional feature. Normally, though not necessarily, the fixed sash is retained in a vertical position by spring loaded sash latches 36, as noted above. Optionally, the fixed sash may be maintained in position by the snap-in guide rail 62. In buildings where building codes stipulate that tenants not remove windows for any purpose, the snap-in guide rail provides a convenient appliance for discouraging such activity. If for any reason the window must be removed for cleaning or servicing the janitorial staff can readily remove the interfering snap-in guide rail 62 and replace it in its slot after cleaning or servicing is complete.

Figure 9A:
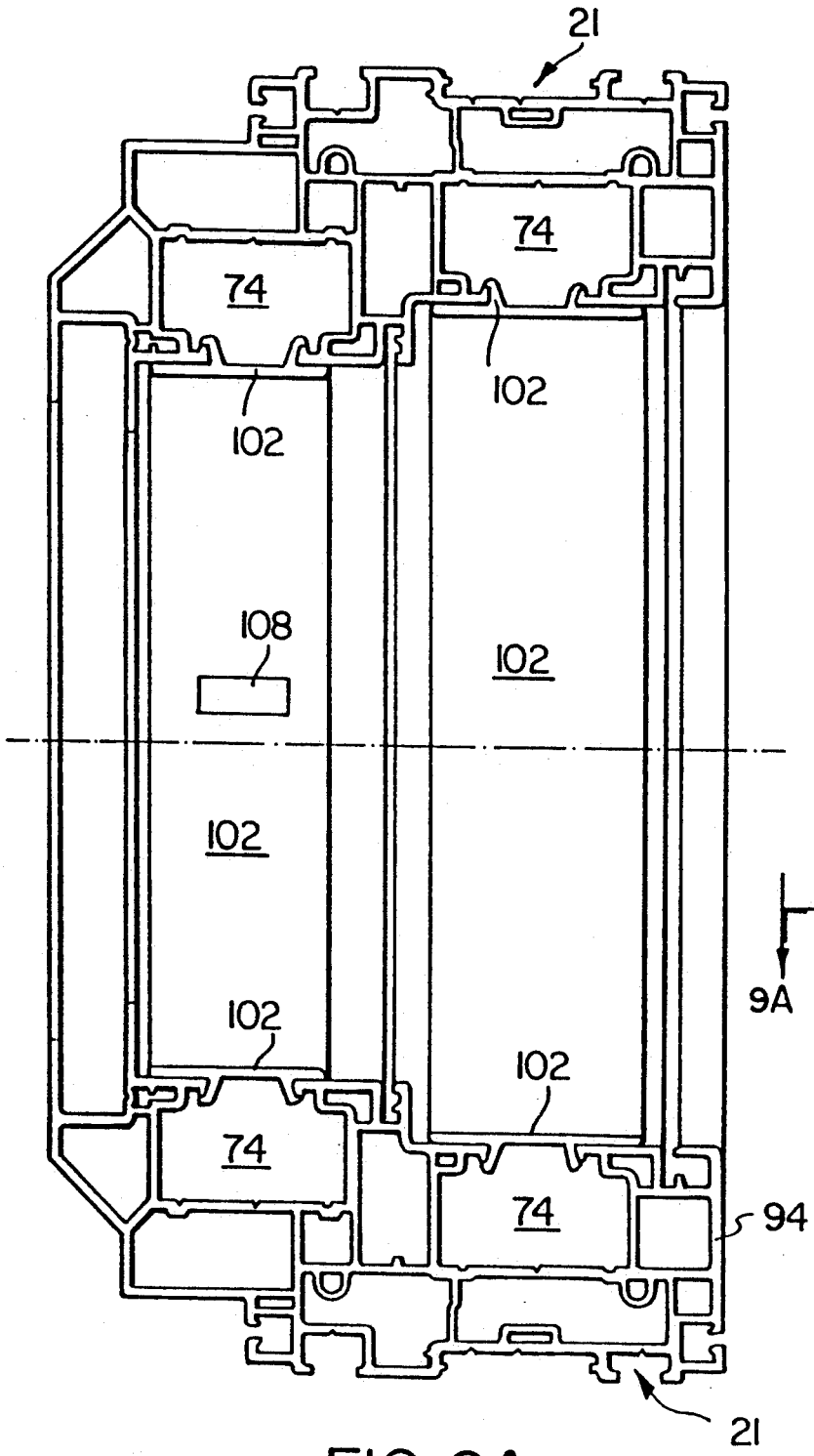
FIG. 9A is a horizontal cross-section taken along line 9A—9A of FIG. 9.
Figure 9:
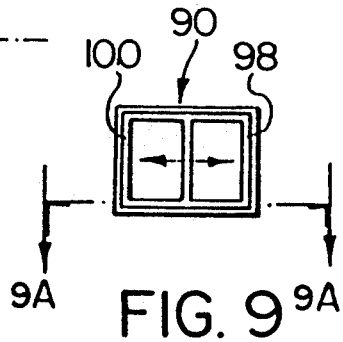
FIG. 9 is a front elevational view of the horizontally sliding window shown in FIG. 5.

FIG. 9 shows the horizontal sliding window 90 illustrated in FIG. 5, in a closed condition.

FIG. 9A is a horizontal cross-section taken along lines 9A—9A in FIG. 9. This figure illustrates the positioning of a fixed sash bottom latch slot 108. The fixed sash is locked in position by a spring loaded sash latch 36 (illustrated in FIG. 5) which engages a rectangular slot 108 cut in the bottom guide track cap 102. As is apparent from the drawing, this notch is located slightly to one side of the center line of the window. If for any reason the position of the fixed sash must be changed so that the sash is located on the fixed opposite side of the window frame, the guide track cap 102 can be removed from its clipped-on attachment to the bottom guide slot 74 after the fixed sash is removed from the frame. The guide track cap 102 can then be rotated 180° and re-inserted in the guide slot. Thereafter, when the fixed sash is relocated in a proper orientation on the opposite side of the frame, the rectangular slot 108 is properly located for receiving a sash latch for locking the fixed sash in position.

Industrial Applicability

As is apparent from the foregoing, a very unique set of a limited number of extruded plastic profiles have been disclosed for the components of a construction kit for horizontally and vertically sliding window assemblies. The extruded plastic profiles hereintofore described are manufactured by techniques well known in the art using materials also well known, namely polyvinychloride, polyethylene, polycarbonate and other suitable thermoplastic or thermoset materials.

Windows constructed in accordance with the invention are suitable for use in commercial, residential and industrial construction, but are particularly well adapted for use in residential construction.

Windows constructed in accordance with the invention may be installed in building structures by any one of numerous techniques well known in the art of plastic window installation.

The embodiments hereintofore described are intended to be exemplary only in their nature, the invention being limited solely by the breadth of the appended claims.

We claim:

1. A meeting rail for a construction kit for horizontally and vertically sliding window assemblies, comprising:

a substantially L-shaped profile having first and second legs which respectively include an inner and an outer surface;

the first leg of the meeting rail being affixable to an edge of a window sash of the window assembly so that the inner surface thereof overlies the edge of the window sash; and the second leg of the meeting rail including means for retaining a weatherstrip on each of the outer surface and the inner surface thereof, said means for retaining the weatherstrip being in opposed relationship on the inner and outer surfaces, a length of weatherstrip longer than the second leg outer surface and engaged by said means for retaining a weatherstrip on the outer surface, said length of weatherstrip extending beyond at least one end of the second leg and wrapped around said end and engaged by the means for retaining the weatherstrip on the inner surface, thereby providing an improved seal between the end of the second leg of the meeting rail and an adjacent frame surface of a window assembly.

2. The meeting rail as claimed in claim 1 wherein the means for retaining the weatherstrip comprises an opposed pair of lips on each surface of the second leg, each said pair of lips forming a slot for retaining the weatherstrip.

3. The meeting rail as claimed in claim 1 wherein the ends of the length of weatherstrip are secured in the slot on the rear surface by compression of the ends against a window sash when the meeting rail is affixed to an edge of the window sash.

4. The meeting rail as claimed in claim 1, further comprising:

a down-turned lip which extends along a side of the inner surface of the first leg of the L-shaped profile;

the second leg depends from an opposite side of the inner surface of the first leg in an orthagonal relation with the first leg;

a locking tab spaced inwardly from the down-turned lip and extending in a parallel relation therewith, the locking tab being positioned to mechanically and frictionally engage a slot in a first side of the edge of the window sash;

a pair of second locking tabs spaced inwardly from the second leg and positioned to mechanically and frictionally engage another slot in an opposite side of the edge of the window sash, said first and second locking tabs cooperating to removably affix the meeting rail to the edge of the sash; and the means for retaining a weatherstrip consists of an opposed pair of lips on each surface of the second leg, each said pair of lips forming a slot for retaining the weatherstrip.

* * * * *